US006484476B2

(12) United States Patent
Yamamoto et al.

(10) Patent No.: US 6,484,476 B2
(45) Date of Patent: Nov. 26, 2002

(54) HORIZONTAL PACKING APPARATUS AND METHOD OF REMOVING FOREIGN MATTER THEREFROM

(75) Inventors: Keisho Yamamoto, Tokyo (JP); Eiji Kobayashi, Yokohama (JP); Osatomi Kawai, Zushi (JP)

(73) Assignee: Strapack Corporation, Tokyo (JP)

( * ) Notice: Subject to any disclaimer, the term of this patent is extended or adjusted under 35 U.S.C. 154(b) by 46 days.

(21) Appl. No.: 09/785,938

(22) Filed: Feb. 16, 2001

(65) Prior Publication Data

US 2001/0042355 A1 Nov. 22, 2001

(30) Foreign Application Priority Data

May 18, 2000 (JP) ..... 2000-145873

(51) Int. Cl.[7] ..... B65B 13/04

(52) U.S. Cl. ..... 53/399; 53/589; 100/2; 100/26

(58) Field of Search ..... 100/2, 8, 26; 53/399, 53/589, 167

(56) References Cited

U.S. PATENT DOCUMENTS

| | | | | | |
|---|---|---|---|---|---|
| 3,060,840 | A | * | 10/1962 | Van De Bilt | 100/26 |
| 3,196,779 | A | * | 7/1965 | Embree | 100/26 |
| 3,327,618 | A | * | 6/1967 | Cook | 100/26 |
| 3,789,751 | A | * | 2/1974 | Burford | 100/4 |
| 3,831,512 | A | * | 8/1974 | Johnson | 100/26 |
| 4,043,261 | A | * | 8/1977 | Mae | 100/26 |
| 4,120,239 | A | * | 10/1978 | Pasic et al. | 100/26 |
| 4,520,720 | A | * | 6/1985 | Urban et al. | 100/26 |
| 4,655,873 | A | * | 4/1987 | Oly | 100/26 |
| 5,333,438 | A | * | 8/1994 | Gurak et al. | 100/26 |
| 5,718,167 | A | * | 2/1998 | Renz et al. | 53/589 |

FOREIGN PATENT DOCUMENTS

| | | | | | |
|---|---|---|---|---|---|
| JP | 53-23799 | A | * | 3/1978 | 100/26 |
| JP | 2-57515 | A | * | 2/1990 | 100/26 |
| JP | 3-111218 | A | * | 5/1991 | 100/25 |
| JP | 05-092104 | U | | 12/1993 | |
| JP | 8-104305 | A | * | 4/1996 | B65B/13/06 |
| JP | 2905346 | B2 | | 3/1999 | |

* cited by examiner

*Primary Examiner*—Stephen F. Gerrity
(74) *Attorney, Agent, or Firm*—Frishauf, Holtz, Goodman & Chick, P.C.

(57) ABSTRACT

A lower part 14L of a band way 14, which is incorporated in an arch unit 12, is separated from the other parts of the band way 14. A drive (air cylinder) 35 supports the lower part 14L, allowing the same to move between a substantially horizontal initial position and an inclined position. A band 13 is released from the band way 14 when a packing operation starts. Thereafter, the lower part 14L is moved from the initial position to the inclined position and compressed air is applied to the guide surface 14*a* of the lower part 14L, thereby removing foreign matter from the band way 14. This sequence of removing foreign matter is performed in, for example, each cycle of packing operation.

17 Claims, 6 Drawing Sheets

HORIZONTAL PACKING APPARATUS AND METHOD OF REMOVING FOREIGN MATTER THEREFROM

BACKGROUND OF THE INVENTION

1. Field of the Invention

The present invention relates to a horizontal packing apparatus that has a body unit with a vertical table, and an arch unit. The table is provided on the vertical side of the body unit, for supporting an article to be packed. The arch unit incorporates a band way, straddles one side of the body unit and surrounds the vertical table. The invention also relates to a method of removing foreign matter from the band way provided in the horizontal packing apparatus.

2. Description of the Prior Art

Packing apparatuses are known each for packing an article by wrapping a band around the article and tying the ends of the band together. Generally, this type of a packing apparatus comprises a body unit, a reel unit, and an arch unit. The body unit has a table for supporting an article to be packed. The reel unit holds bands. The arch unit is shaped like an arch, straddling one side of the body unit and surrounding the vertical table of the body unit, and incorporates a band way along which a band is fed or guided. The body unit incorporates a sealing unit, which feeds a band, draws back the band, tightens the band and ties the ends of the band together. The band is released from the band way as it is drawn back. The band is then wrapped around the article, whereby the article is packed.

In a vertical packing apparatus, the horizontal table is aged on the upper surface of the body unit, and the arch unit straddles the body unit and surrounds the horizontal table. In a horizontal packing apparatus, the vertical table is provided at, for example, the left (vertical) side of the body unit, the arch unit straddles the left side of the body unit and surrounds the vertical table, and the body unit is not located right below the article to be packed.

The article to be packed may be vegetable, lawn or hay. While a packing apparatus is packing such an article, foreign matter (e.g., earth or hay splinters) fall from the article. The foreign matter is likely to fall into the body unit, particularly sealing unit, of the packing apparatus and to deposit therein. As indicated above, a horizontal packing apparatus has a table on the vertical side of the body unit, or receiving and supporting an article to be packed, and the body unit is not right below the article to be packed. Hence, when the horizontal packing apparatus packs an article, such as vegetable, lawn, hay, or the like, the foreign matter (e.g., hay splinters) broken off from the article can be prevented from entering the body unit and depositing therein Consequently, this maintains the desired efficiency of the horizontal packing apparatus.

In the horizontal packing apparatus, too, wherein the arch unit straddles one side of the body unit and surrounds the vertical table, a band is wrapped around an article at the position where the article is aligned with the arch unit, and foreign matter, e.g, hay splinters, may fall from the article (e.g., vegetable, lawn, or hay). The foreign matter fallen from the article may enter the arch unit and deposit therein, particularly on the upper surface of the lower section of the band way, which is incorporated in the arch unit.

The upper surface of the lower section of the band way serves to guide a band in the process of applying the band to pack an artcle. Foreign matter, if any deposited on the upper surface of the lower section of the band way, blocks the band being fed toward the article along the band way. This inevitably reduces the operating efficiency of the packing apparatus.

Usually, a flexible cover or the like is provided above the lower section of the band way and used as a dust cover. The flexible cover prevents foreign matter falling from the article to be packed, from entering the lower section of the band way. The flexible cover alone cannot completely prevent the foreign matter from entering the lower section of the band way or depositing therein This is because the foreign matter may fall through the space around the edges of the flexible cover. Generally, maintenance is performed, thereby removing the foreign is matter from the upper surface of the lower section of the band way.

To perform the maintenance for removing the foreign matter, the packing apparatus must be stopped. It is necessary to stop the packing apparatus rather frequently. This greatly decreases the operating efficiency of the packing apparatus.

Any packing apparatus incorporated in an automatic packing line must be detached from the line to receive the maintenance work for removing the foreign matter. The automatic packing line remain idle while the packing apparatus is being detached from the packing line, the foreign matter is being removed and the apparatus is being attached back to the packing line. This jeopardizes the operating efficiency of the automatic packing line. Moreover, intricate work is involved in detaching the packing apparatus from the automatic packing line and attaching the same back to the automatic packing line. Some measures must therefore be taken to avoid a decrease in the operating efficiency of the automatic packing line.

Japanese Utility Model Application KOKAI Publication No. 05-092104 discloses a packing apparatus that is not a horizontal one. In this apparatus, compressed air is applied to remove foreign matter from the band way. Relatively light matter, such as hay splinters, can be blown away from the band way. However, relatively heavy matter, such as earth and pebbles, cannot be reliably removed from the band way.

SUMMARY OF THE INVENTION

The first object of the present invention is to provide a horizontal packing apparatus in which foreign matter can be prevented from depositing on the band way and foreign matter, if deposited, can be removed from the band way. The second object of the invention is to provide a method of removing foreign matter from the band way of a horizontal packing apparatus.

To achieve the first object, a horizontal packing apparatus according to the invention is characterized in some respects. First, the lower part of the band way, which is incorporated in an arch unit, is separated from the other parts of the band way. Second, drive means supports the lower part, allowing the same to move between a substantially horizontal initial position and an inclined position. It is desired that the lower part of the band way be inclined downwards in its widthwise direction, not in its lengthwise direction (i.e., the direction in which a band is fed).

To achieve the second object of the invention, a method of removing foreign matter from a horizontal packing apparatus, according to the present invention, comprises the steps of: moving the lower part of the band way of the apparatus from an initial position that is substantially horizontal to an inclined position in which the lower part is inclined downwards, after a packing operation starts and a band is released from the band way; and moving the lower part of the band back to the initial position from the inclined position.

DETAILED DESCRIPTION OF THE PREFERRED EMBODIMENTS

Embodiments of the present invention will be described in detail with reference to the accompanying drawings.

Figure 1:
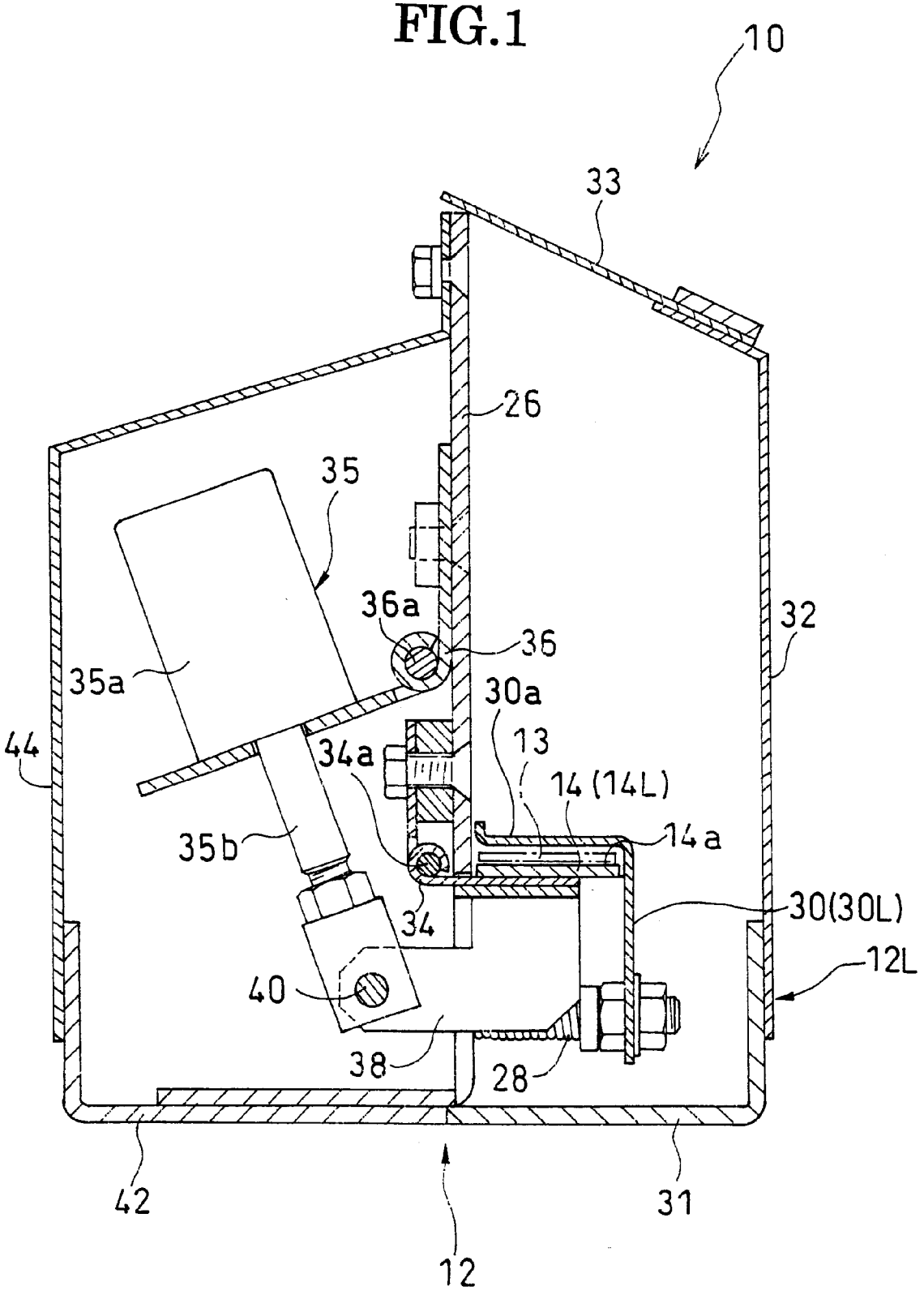
FIG. 1 is a vertical sectional front view of a horizontal packing apparatus according to the present invention, in which the lower part of the band way lies in a substantially horizontal initial position.
Figure 2:
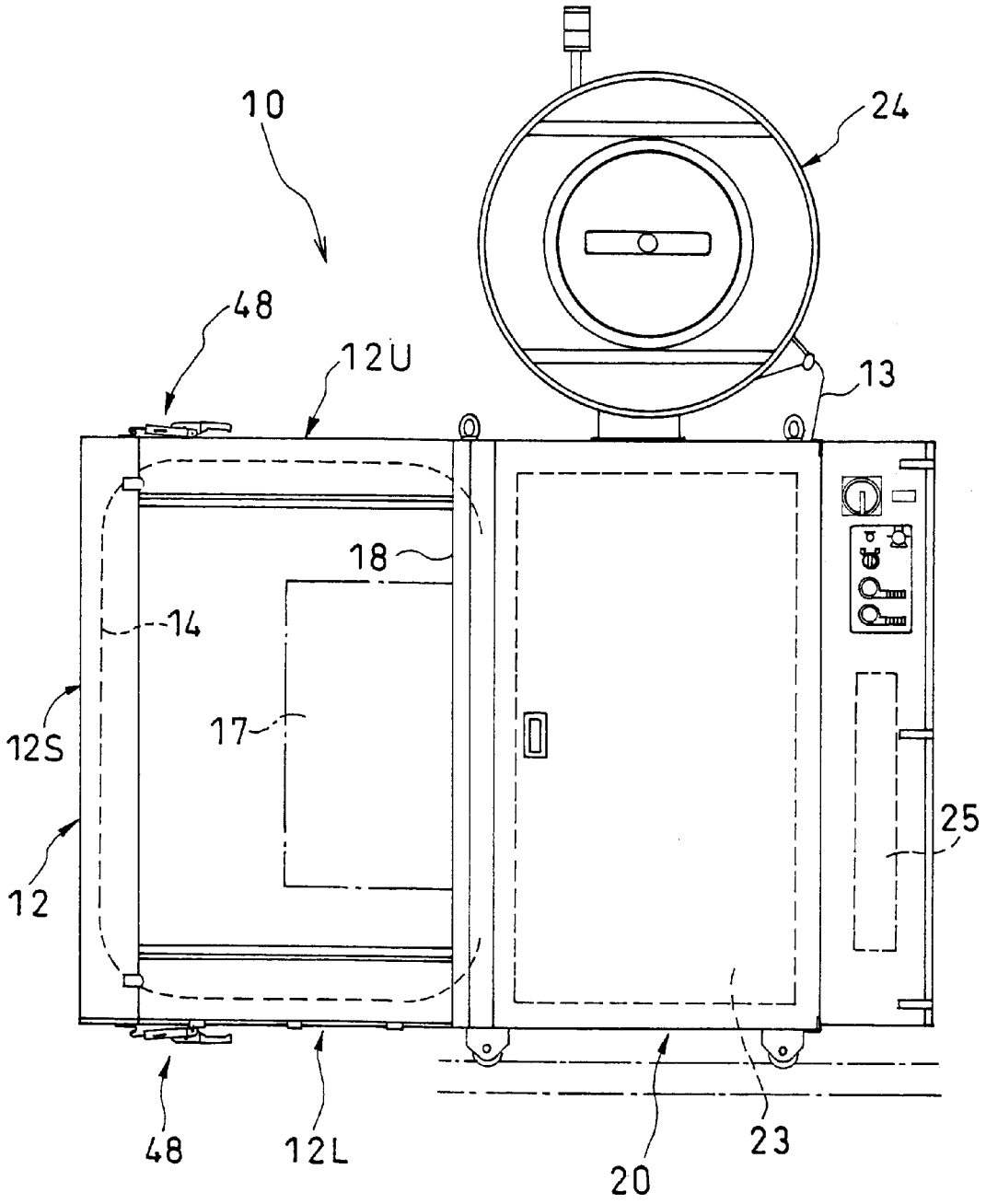
FIG. 2 is a front view of the horizontal packing apparatus according to the invention.

As shown in FIG. 1 and FIG. 2, a horizontal pack apparatus 10 according to this invention comprises an arch unit 12 and a band way 14 incorporated in the arch unit 12. A packing band 13 is fed along the band way 14

As shown in FIG. 2, the horizontal packing apparatus 10 further comprises a table 18, a body unit 20 and a reel unit 24. The table 18 is provided on a vertical side of the body unit 20, for supporting an article 17 that will be packed. The arch unit 12, which has a channel-shaped cross section, is located beside the table 18. The reel unit 24 is designed to hold bands. The body unit 20 incorporates a sealing unit 23. The sealing unit 23 includes a band-supplying device and a sealing device. The band-supplying device is driven by, for example, an electric motor, to feed the band 13, draw back the band 13 and tighten the band 13. The sealing device is driven by, for example, an electric motor to hold the band 13, cut the band 13 and fasten the ends of the band 13. An automatic control circuit 25 is incorporated in the body unit 20. Both the band-supplying device and the sealing device are controlled in accordance with the program provided in the automatic control circuit 25. The article 17 is thereby packed automatically on the table 18.

The leading end portion of the band 13, which extends from the reel unit 24 for some distance, is inserted into the body unit 20. When the insertion of the band 13 is detected, the automatic control circuit 25 controls the sealing unit 23 in accordance with the program. Thus controlled, the sealing unit 23 feeds the band 13 into the arch unit 12, extending over the entire band way 14. Meanwhile, conveyor units (e.g., belt conveyors or roller conveyors) that are arranged in front of the arch unit 12 and at the back thereof convey the article 17 in front of the table 18. Thereafter, the sealing unit 23 draws the band 13 back and releases the same from the band way 14 The band 13 is thereby wrapped around the article 17. The sealing unit 23 tightens and cuts the band 13. Further, the sealing unit 23 fuses and fastens together the ends of the band 13 wrapped around the article 13. Thus, the horizontal packing apparatus 10 packs the article 17.

The above-mentioned sequence of packing steps, performed in the horizontal packing apparatus 10, is known in the art and is not the gist of the present invention. Neither the sequence nor the mechanism that performs it shall be described here in detail.

The arch unit 12 provided in the horizontal packing apparatus 10 may be similar in basic structure to the one disclosed in, for example, Japanese Patent No. 2905346. The arch unit 12 will be described below, with reference to FIG. 1 and FIG. 3.

In the arch unit 12, the band way 14 extends along an arch frame 26 that is the main component of the arch unit 12. Flaps 30 having an L-shaped cross section are laid on the upper surface 14*a* of the band way 14, providing an open space into which the band 13 can be fed. The upper surface 14*a* of the band way 14 serves to guide the band 13. The flap 30 is coupled to the arch flame 26 by bolts 28, each having a spring that can be elastically deformed and restored.

The flaps 30 can rotate around the bolts 28 since they merely cover the upper (guide) surface 14*a* of the band way 14 and are spaced apart therefrom. Thus, the flaps 30 are rotated around the bolts 28 when the sealing unit 23 draws back the band 13, rotating the flaps 30 upwardly from the guide surface 14*a*. The band 13 is thereby smoothly released from the band way 14.

As seen from FIG. 1, an arch cover 32 extends upwards from, for example, the lower part of a support plate 31. The arch cover 32 protects the entire band way 14. Further, a flexible cover 33 that is restorable extends from the top of the arch cover 32 to the top of the arch frame 26. The flexible cover 33 is a dust cover that prevents foreign matter falling from the article 17, from entering the arch unit 12.

In most horizontal packing apparatus, the band way is secured to the arch frame. In the packing apparatus 10 of this invention, the lower part 14L of the band way 14 is separated from the other part of the band way 14 and can move with respect to the arch frame 26. The lower part 14L extends straight along the lower part 12L of the arch unit 12 and is aligned with, for example, a long flap 30L.

Figure 3:
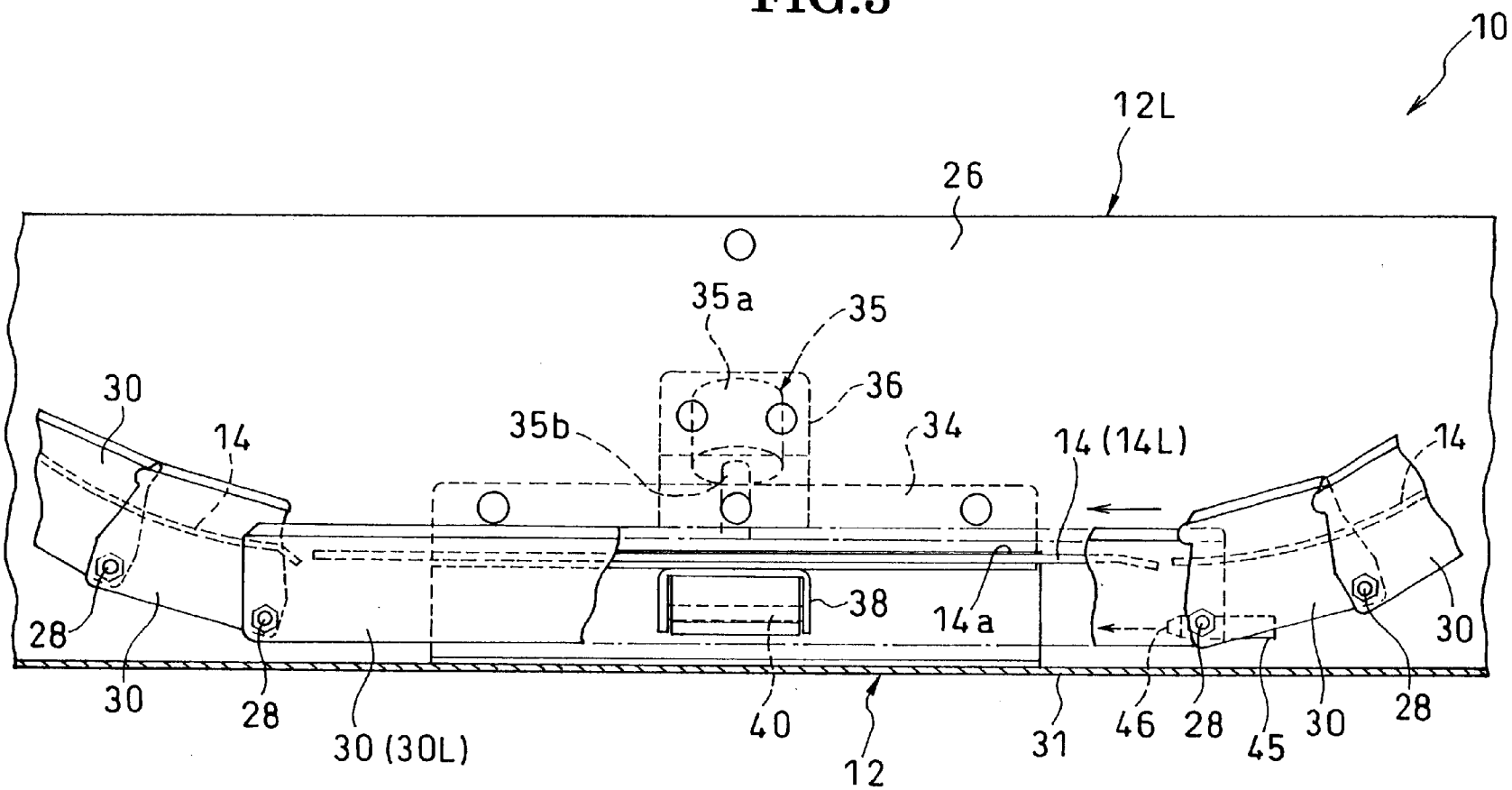
FIG. 3 is a front view illustrating the lower section of the arch unit incorporated in the horizontal packing apparatus.
Figure 4:
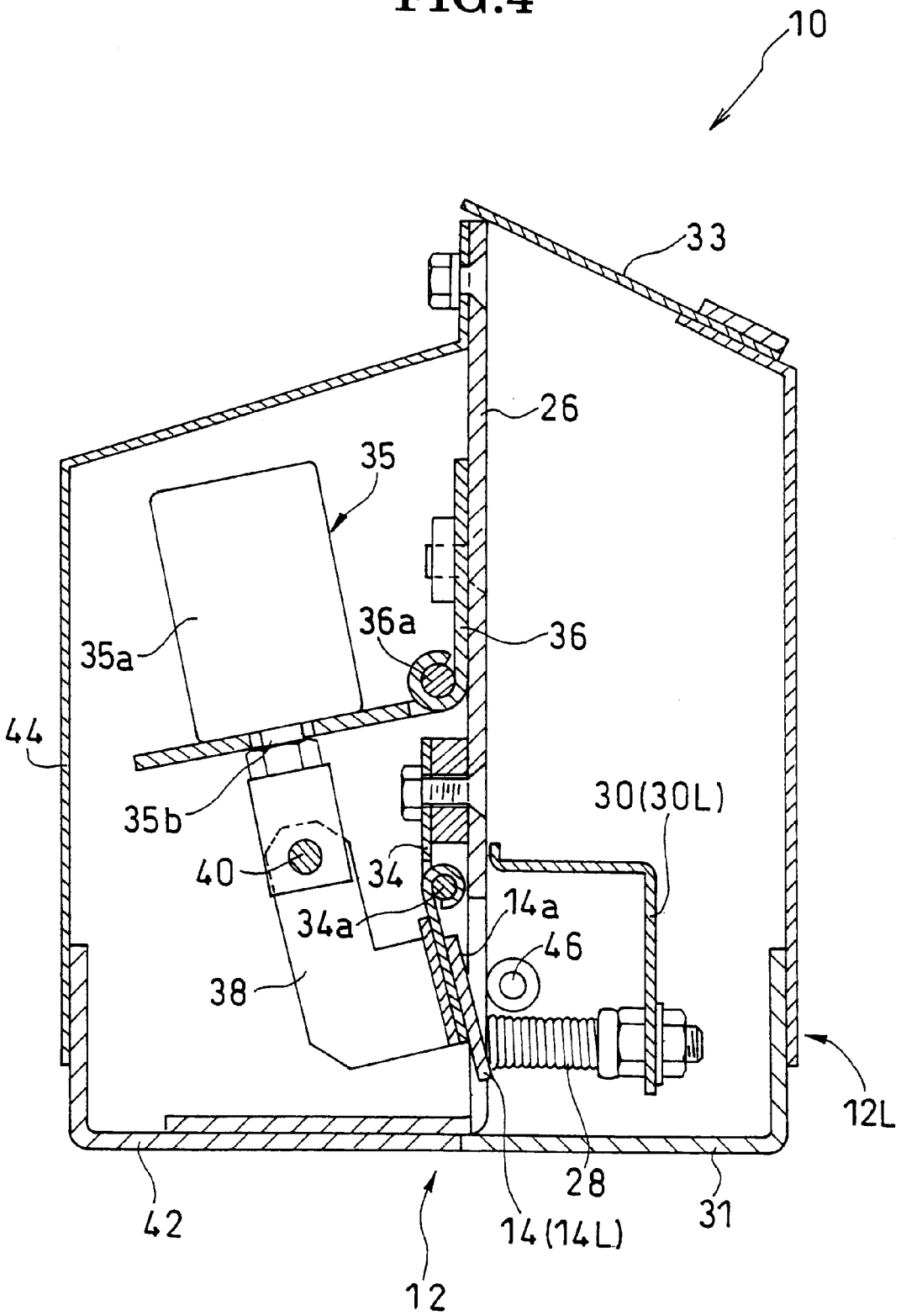
FIG. 4 is another vertical, sectional front view of the horizontal packing apparatus, in which the lower part of the band way lies in an inclined position.

As shown in FIG. 1, FIG. 3 and FIG. 4, the present embodiment has a hinge 34. One half of the hinge 34 is fastened to the arch frame 26. The other half of the hinge 34 is fastened to the lower surface of the lower part 14L of the band way 14. The lower part 14L of the band way 14 can therefore rotate to move out of the arch unit 12. Drive means 35 is provided, which includes a main body 35*a* and a piston 35*b*. The piston 35*b* can move back and forth to control the rotation of the lower section 14L of the band way 14.

The drive means 35 may be an air cylinder that expands when compressed air is forced into it and contracts when the air is released from it.

As can be understood from FIG. 1, the air cylinder (drive means) 35 is located beside the arch frame 26 of the arch unit 12. A hinge 36 couples the main body 35*a* of the air cylinder 35 to the arch frame 26. A pivotal pin 40 couples a bracket 38 to the piston 35*b* of the air cylinder 35. The bracket 38 is secured to the lower part 14L of the band way 14. Hence, the bracket 38 rotates clockwise around the pivotal pin 40 when the piston 35*b* retracts. As the bracket 38 thus rotates, the lower part 14L of the band way 14 rotates clockwise around the axis 34*a* of the hinge 34. The lower part 14L therefore moves from its almost horizontal position shown in FIG. 1 to an inclined position shown in FIG. 4 The rotation locus of the lower part 14L of the band way 14 differs from that rotation locus of the bracket 38. Nonetheless, this difference is small enough to be absorbed when the air cylinder 35 rotates around the axis 36*a* of the hinge 36.

A cylinder cover 44 stretches between the upper edge of the arch frame 26 and the lower part 42 of the support plate 31. Thus arranged, the cylinder cover 44 prevents the air cylinder 35 from being exposed.

When the lower part 14L of the band way 14 is rotated from its horizontal position (FIG. 1) to its inclined position (FIG. 4), the foreign matter deposited on the guide surface 14*a* of the lower part 14L falls, slipping down the guide source 14*a*. The foreign matter is reliably removed from the band way 14, whether it is relatively light like grass splinters or comparatively heavy like earth and pebbles.

After the foreign matter has been removed from the band way 14, the air cylinder 35 is expanded. The lower part 14L of the band way 14 is thereby rotated counterclockwise around the axis 34*a* of the hinge 34 as is illustrated in FIG. 4. The lower part 14L returns to its initial position that is substantially horizontal as shown in FIG. 1. Immediately after the lower part 14L resumes its initial position, the band 13 may be fed along the guide surface 14*a* of the lower part 14L. Foreign matter no longer lies on the guide surface 14*a*. The band 13 is therefore smoothly fed from the reel unit 24 into the band way 14 and can be wrapped around the article 17, as in the prior art.

In the horizontal packing apparatus 10 according to this invention, the lower part 14L of the band way 14, which lies below the article 17 during the packing operation, is separated from any other parts of the band way 14 and can be moved. The lower part 14L of the band way 14 remains below the article 17 throughout the packing operation. After the article 17 is duly packed, the lower part 14L is rotated from the almost horizontal initial position to the inclined position, making foreign matter fall from the guide surface 14*a* of the lower part 14L. This reliably prevents foreign matter, e.g., grass splinters and the like, from depositing on the guide surface 14*a* of the lower part 14L. A maintenance work need not be performed to remove the foreign matter from the guide surface 14*a*.

In the present embodiment, the hinge 36 supports the air cylinder (drive means) 35, allowing the air cylinder 35 to rotate. Nevertheless, the air cylinder 35 need not be made to rotate, if the difference in locus between the hinge 34 and the bracket 38 can be eliminated For example, the air cylinder 35 is fixed in place, while the pivotal pin 40 is made to move in an elongated guide hole.

The hinge 36 supports the air cylinder 35, allowing the same to rotate. When the air cylinder 35 is rotated around the aids 36*a* of the hinge 36, the difference in locus between the hinge 34 and the bracket 38 is readily eliminated. Therefore, the lower part 14L of the band way 14 can smoothly move back and forth between its initial position and its inclined position, without complicating the structure of the packing apparatus 10. Foreign matter may fall onto, and may accumulate on, a particular section of the lower part 14L If so, this section of the lower part 14L may be separated from the other sections of the band way 14 and may be movably coupled to the arch frame 26.

The pivotal pin 40 couples the piston 35*b* of the air cylinder 35 to the L-shaped bracket 38 that is secured to the lower part 14L of the band way 14 Thus, the angle at which the lower part 14L is supported can be varied as the air cylinder 35 expands or contracts. Nonetheless, the lower part 14L can be movably supported in another manner, so long as it can move between the initial position that is almost horizontal and the inclined position in which the lower part 14L tilts downwards as the piston 35*b* of the air cylinder 35 moves back and forth.

In the present embodiment, the L-shaped bracket 38 connects the lower part 14L to the piston 35*b* of the air cylinder 35. The air cylinder 35 therefore supports the lower part 14L of the band way 14. Thus, a relatively simple structure supports the lower part 14L, allowing the same to move.

As indicated above, the means 35 for driving the lower part 14L is an air cylinder. The drive means 35 is not limited to an air cylinder. Any other device that can control the movement of the lower part 14L can be employed in place of the air cylinder 35. The drive means 35 may be, for example, a solenoid or the like.

As described above, the lower part 14L of the band way 14 inclines downwards as it is rotated around the axis 34*a* of the hinge 34, which lies beside the lower part 14L. Instead, the lower part 141 may incline downwards as it is rotated in its lengthwise direction (ie., the direction in which the band 13 is fed) around an axis (not shown) that lies below the band way 14. This is because the lower part 14L only needs to incline from the almost horizontal initial position in which the lower part 14L functions as a part of the band way 14 for guiding the band 13.

Alternatively, in the present embodiment, the lower part 14L of the band way 14 is inclined downwards in its widthwise direction, not in its lengthwise direction. In this case, the lower part 14L can incline at a large angle, reliably causing the foreign matter to fall from the guide surface 14*a* of the lower part 14L. Thus, it is possible to remove the foreign matter from the band way 14 In the embodiment, the lower part 14L does not protrude above its initial position and will not abut on the top edge 30*a* of the flap 30. In addition, the space in which the lower part 14L moves between its initial position and its inclined position is small. This helps to reduce the size of the arch unit 12.

In most factories wherein horizontal packing apparatus 10 is employed, a compressed air system is installed, which comprises a compressor for supplying high-pressure compressed air. The air cylinder (drive means) 35 is connected to an air-supply tube of the compressed air system. It is therefore easy to supply the compressed air to the air cylinder 35. How the air cylinder 35 is connected to the air-supply tube will be later described in detail.

In the embodiment described above, the lower part 14L of the band way 14 is inclined, causing the foreign matter to fall under gravity. This prevents the foreign matter from depositing on the guide surface 14*a* of the band way 14. It is desired that some measures be taken to remove the foreign matter, in addition to the inclination of the lower part 14L. For example, an air-applying means may be used to apply compressed air onto the guide surface 14*a* of the lower part 14 in order to remove the foreign matter from the guide surface 14*a*.

Figure 5:
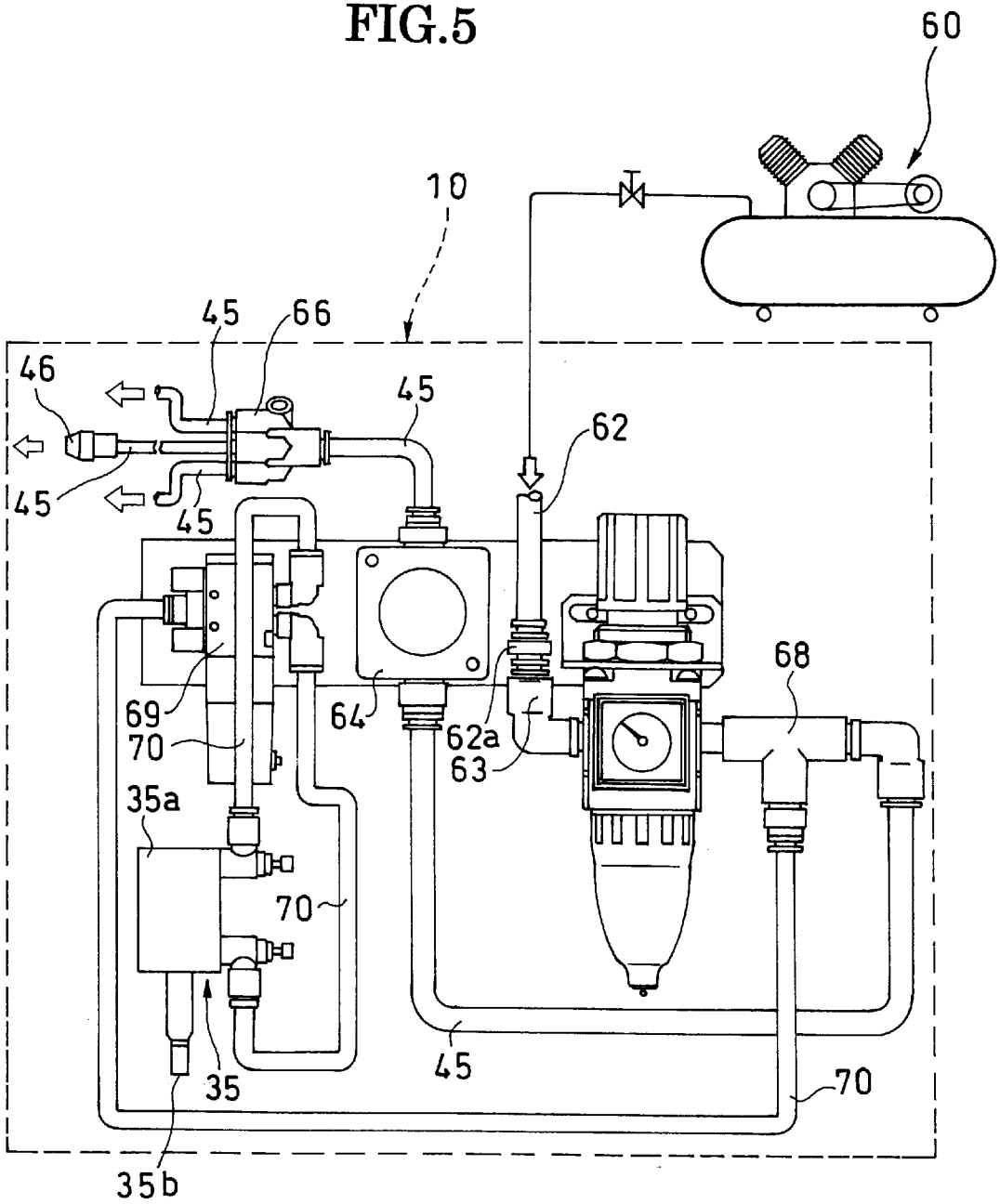
FIG. 5 is a diagram showing the air-hose arrangement in the horizontal packing apparatus.

The air-applying means may be an air compressor 60 as shown in FIG. 5. The air compressor 60 is installed in the factory in which the horizontal packing apparatus 10 is employed. As shown in FIG. 5, the air compressor 60 has an air hose (tube) 62, while the packing apparatus 10 has an air hose 45 and a connector 63. The connector 63 connects the output end 62*a* of the air hose 62 to the air hose 45, whereby compressed air is supplied from the air compressor 60 (air-applying means) to the horizontal packing apparatus 10. As shown in FIG. 3, the air-outlet port 46 of the air hose 45 is arranged on the guide surface 14*a* of the lower part 14L. The air-outlet port 46 is positioned to apply the compressed air in the direction of feeding the band 13 (i.e., the direction of the arrow shown in FIG. 3).

The compressed air is automatically applied from the air-outlet port 46 of the air hose 45 when the lower part 14L of the band way 14 is rotated from the initial position to the inclined position As shown in FIG. 5, a control valve 64, such as a solenoid valve or the like, is provided on the air hose 45 and located between the air compressor 60 and the air-outlet port 46. The control valve 64 is operated in synchronism with the rotation of the lower part 14L of the band way 14, from the initial position to the inclined position and vice versa. For instance, the control valve 64 is opened when the lower part 14L reaches its inclined position, thereby applying the compressed air from the air-outlet port 46. And the control valve 64 is closed when the lower part 14L starts moving from the inclined position to the initial position, thereby interrupting the supply of compressed air.

The foreign matter deposited on the guide surface 14*a* of the lower part 14L may be sticky and would not fall under gravity from the guide surface 14*a* when the lower part 14L is inclined. In this case, the compressed air applied from the air-outlet port 46 blows the foreign matter away from the guide surface 14*a*. This reliably prevents the foreign matter from depositing on the guide surface 14*a* of the lower part 14L.

The method of applying the compressed air at the guide surface 14*a* is not limited to the one described above. Rather, a distributor 66 may branch the air hose 45 as shown in FIG. 5, thus providing several air-outlet ports at those part of the band way 14 where foreign matter is likely to deposit. For example, the air-outlet ports may be arranged the upstream end and downstream end of the lower part 14L, whereby the compressed air is applied to the guide surface 14*a* of the lower part 14L in regular order.

Moreover, the compressed air is supplied to the air cylinder (drive means) 35 through a distributor 68, a changeover valve 69 and an air-distributing hose 70, thereby to drive the air cylinder 35. Therefore, any other air compressor need not be provided to drive the air cylinder 35. This serves to simplify the packing apparatus 10.

The motion of the lower part 14L between the initial position and inclined position, and the application of compressed air to the guide surface 14*a* of the lower part 14L may be manually controlled. More precisely, push buttons may be provided, which the operator of the packing apparatus 10 operates whenever required. Alternatively, the rotation of the lower part 14L and the application of compressed air may be automatically performed in each cycle of packing operation If this is the case, it is possible to prevent the deposition of foreign matter easily and reliably.

How the lower part 14L of the band way 14 is operated and how the compressed air is applied from the air-outlet port 46, during one cycle of packing operation, will be described with reference to FIG. 1 to FIG. 5.

The changeover valve 69 and the control valve 64 are controlled in accordance with the program incorporated in the automatic control circuit 25. Thus controlled, the changeover valve 69 and control valve 64 control the rotation of the lower part 14L from the initial position to the inclined position and vice versa, and the application of compressed air from the air-outlet port 46 of the air hose 45.

When an article 17 to be packed is placed beside the table 18 as shown in FIG. 2, the packing operation is started. That is, the band 13 is drawn back, released from the band way 14 and wrapped around the article 17. The changeover valve 69 is operated, causing the piston 35*b* of the air cylinder 35 to retract. As a result, the lower part 14L of the band way 14 moves from the initial position shown in FIG. 1 to the inclined position shown in FIG. 4. When the piston 35*b* retracts to maximum, it is determined that the lower part 14L of the band way 14 has reached the inclined position. At this time the control valve 64 is opened, whereby the compressed air is applied onto the guide surface 14*a* of the lower part 14L from the air-outlet port 46 of the air hose 45. Foreign matter is thereby removed from the guide surface 14*a*. The rotation of the lower part 14L, from the initial position to the inclined position, is detected when the piston 35*b* of the air cylinder 35 retracts to maximum.

The compressed air is applied from the air-outlet port 46 onto the guide surface 14*a* for the time set in the timer incorporated in the automatic control circuit 25 that is provided in the body unit 20. Upon lapse of the time set in the timer, the control valve 64 closes, terminating the application of compressed air from the air-outlet port 46 of the air hose 45.

While the compressed air is being applied onto the guide surface 14*a*, the sealing unit 23 packs the article 17. To be more specific, the sealing unit 23 wraps the band 13 around the article 17, tightens the band 13 and fastens the ends of the band 13 together, in the same way as in the conventional packing apparatus. When it is detected that the ends of the band 13 have been fastened together and that the compressed air has been applied from the air-outlet port 46, the changeover valve 69 is operated, causing the piston 35*b* of the air cylinder 35 to extend forward. The lower part 14L of the band way 14 therefore returns to the initial position that is substantially horizontal as shown in FIG. 1. At the same time, the band 13 to be used in the next packing cycle is fed over the entire band way 14 as is illustrated in FIG. 2. Thus, the packing cycle is completed.

As described above, the lower part 14L is rotated from the initial position to the inclined position, the compressed air is applied from the air-outlet port 46 and the lower part 14L is rotated back to the initial position from the inclined position. This sequence of operation is automatically performed in each packing cycle, in accordance with the program incorporated in the automatic control circuit 25. The packing cycle need not be interrupted to remove foreign matter from the lower part 14L of the band way 14. In other words, it is unnecessary to interrupt the packing operation in order to carry out maintenance work for removing the foreign matter. The packing apparatus 10 can therefore pack articles continuously, thus enhancing the efficiency of packing operation.

The timing of inclining the lower part 14L of the band way 14, applying the compressed air onto the guide surface 14*a* and rotating the lower part 141 back to the initial position is not limited to the one specified above. These operations may be effected at any other times, as far as they are automatically carried out in the order they are mentioned.

In the present embodiment, the lower part 14L is rotated from the initial position to the inclined position after the band 13 has been released from the band way 14. And the lower part 14L is rotated back to the initial position from the inclined position after the ends of the band 13 have been fastened together and the compressed air has been applied from the air-outlet port 46 of the air hose 45. Therefore, it is possible to remove the foreign matter from the lower part 14L of the band way 14, without hindering the feeding of the band 13 along the band way 14 or the wrapping of the band 13 around the article 17. Nevertheless, the lower part 14L may be rotated between the initial position and the inclined position at different times during each packing cycle, provided that the lower part 14L thus rotated does not hinder the feeding of the band 13 or the wrapping the band 13 around the article 17.

The foreign matter is removed from the lower part 14L of the band way 14 in each packing cycle. Instead, it may be removed every two packing cycles or every three packing cycles.

If the foreign matter is removed in each packing cycle as in the embodiment described above, it can be prevented, without fail, from depositing on the guide surface 14*a* of the lower part 14L.

Generally, it is required that horizontal packing apparatuses used in an automatic packing line be subjected to regular maintenance. To receive maintenance work each horizontal packing apparatus must be detached from the line. To detach a horizontal packing apparatus from an automatic packing line is an intricate work that cannot be carried out easily or quickly. This is because the arch unit of the horizontal packing apparatus is arranged between the belt conveyors or roller conveyors, which are other components of the automatic packing line. It is difficult to detach the apparatus from the line, particularly because the conveyor unit lies between the vertical section of the arch unit and the body unit The horizontal packing apparatus 10 of this invention is designed to be easily detached from, and attached to, an automatic packing line. More precisely, as shown in FIG. 2, the arch unit 12 comprises a lower section 12L an upper section 12U and a vertical section 12S. The lower section 12L and the upper section 12U are secured to the body unit 20. By contrast, the vertical section 12S is removably coupled to the lower section 12L and upper section 12U by means of, for example, coupling members 48.

Figure 6:
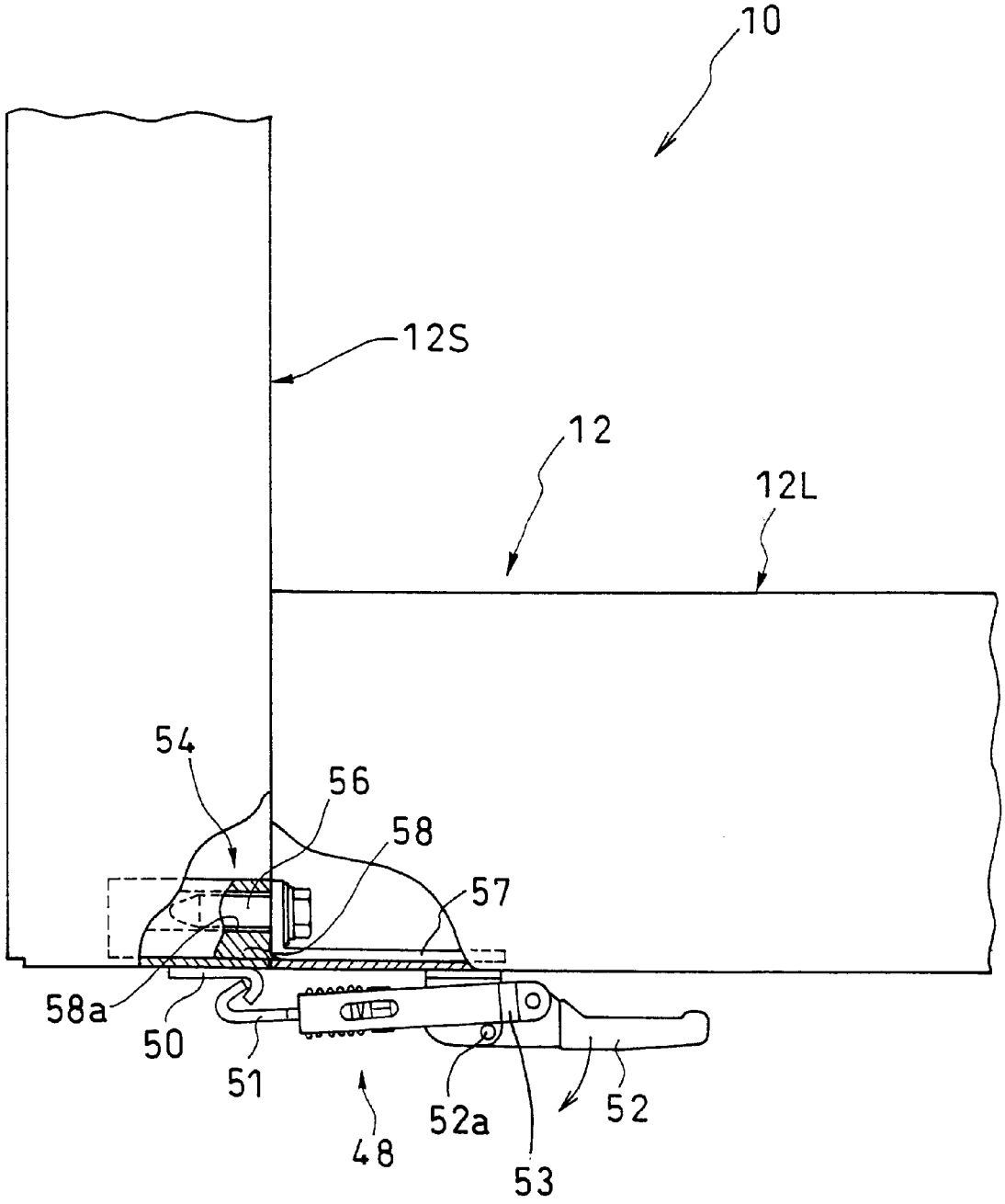
FIG. 6 is a magnified, partly cutaway front view of the arch unit incorporated in the horizontal packing apparatus.

The coupling members 48 are, for example, lever-type ones. The coupling members 48 are identical in structure. Only one of them will, therefore, be described with reference to FIG. 6. The coupling member 48 couples the vertical section 12S and the lower section 12L together. As shown in FIG. 6, the coupling member 48 comprises two hooks 50 and 51, a lever 52 and a hook holder 53. The hooks 50 and 51 can be engaged with each other. The hook 50 is secured to the vertical section 12S. The hook 51 is fastened to the hook holder 53. The hook holder 53 is connected to the lever 52. The lever holder 53 is secured to the lower section 12L.

The lever-type coupling member 48 is characterised in that a spring biases the hook 51 secured to the hook holder 53, toward the hook 50. The bias on the hook 51 enables the hook 51 to engage with the hook 50 easily and reliably. That is, when the lever 52 is rotated around a pin 52*a* in the direction of the arrow depicted in FIG. 6, the hook 51 is released from the hook 50. When the lever 52 is rotated in the opposite direction around the pin 52*a,* the hook 51 comes into engagement with the hook 50. Thus, the hooks 50 and 51 can come into and out of mutual engagement, both quickly and reliably, as the lever 52 is rotated around the pin 52*a.*

The coupling members 48 are of known lever-type. It follows that the structure and operation of the coupling members 48 are known in the art and, thus, not essential to the present invention. Therefore, the coupling members 48 will not be described in more detail.

It is sufficient for the coupling members 48 to removably couple the vertical section 12S to the lower section 12L and upper section 12U. The coupling members 48 can, of course, be other than the lever-type ones shown in FIG. 6, if they have the function of coupling the vertical section 12S to the lower section 12L and upper section 12U.

As described above, the coupling members 48 can connect the vertical secton 12S, lower section 12L and upper section 12U of the arch unit 12 together and disconnect them from one another. The horizontal packing apparatus 10 can, therefore, be detached from an automatic packing line and incorporated back into the line, not hindered by the conveyor units that are provided before and after the arch unit 12. This renders it easy to carry out maintenance on the apparatus 10 at regular intervals.

In this structure it is desired that the vertical section 12S of the arch unit 12 be easily connected to and disconnected from the lower and upper sections 12L and 12U. It is also desired positioning means 54 be provided to prevent a lateral displacement of the vertical section 12S with respect to the lower and upper sections 12L and 12U. As shown in FIG. 6, the positioning means 54 is a combination of a pin 56 and a pin holder 58. The pin holder 58 has a hole 58*a* into which the pin 56 can be inserted. An L-shaped bracket 57 is secured to the lower section 12L of the arch unit 12. The pin holder 58 is fastened to the vertical section 12S. The pin 56 is fitted in the pin holder 58. The vertical section 12S is positioned with respect to the lower section 12L with the distal end of the pin 56 inserted into the hole 58*a* of the pin holder 58.

What is claimed is:

1. A horizontal packing apparatus comprising:

a body unit having a vertical table for supporting an article to be packed;

a reel unit for holding bands;

an arch unit straddling one side of the body unit and surrounding the vertical table; and a band way provided in the arch unit, defining a passage for a band fed from the reel unit, and having a lower part that can be disconnected from the other parts, wherein the band released from the band way is wrapped around the article supported on the vertical table, thereby to pack the article, and the arch unit includes drive means supporting the lower part of the band way and designed to move the same between an initial position that is substantially horizontal and an inclined position in which the lower part is inclined downwards.

2. The horizontal packing apparatus according to claim 1, wherein the drive means inclines the lower part of the band way downwards in a widthwise direction of the band way.

3. The horizontal packing apparatus according to claim 2, wherein the arch unit includes a lower section, an upper section and a vertical section, the lower and upper sections are secured to the body unit, the vertical section is removably attached to the lower and upper sections.

4. The horizontal packing apparatus according to claim 1, further comprising an air hose having an air-outlet port for applying compressed air onto the lower part of the band way while the lower part remains in the inclined position.

5. The horizontal packing apparatus according to claim 4, wherein the arch unit includes a lower section, an upper section and a vertical section, the lower and upper sections are secured to the body unit, the vertical section is removably attached to the lower and upper sections.

6. The horizontal packing apparatus according to claim 1, wherein the arch unit includes a lower section, an upper section and a vertical section, the lower and upper sections are secured to the body unit, the vertical section is removably attached to the lower and upper sections.

7. A horizontal packing apparatus comprising:

a body unit having a vertical table for supporting an article to be packed;

a reel unit for holding bands;

an arch unit straddling one side of the body unit and surrounding the vertical table; and a band way provided in the arch unit, defining a passage for a band fed from the reel unit, and having a lower part that can be disconnected from the other parts, wherein the band released from the band way is wrapped around the article supported on the vertical table, thereby to pack the article, the arch unit includes drive means supporting the lower part of the band way and designed to move the same between an initial position that is substantially horizontal and an inclined position in which the lower part is inclined downwards, and the body unit includes an automatic control circuit incorporating a program for automatically moving the lower part of the band way from the initial position to the inclined position and back to the initial position from the inclined position, at appropriate times during the packing operation.

8. The horizontal packing apparatus according to claim 7, wherein the program incorporated in the automatic control circuit is designed to apply compressed air to the lower part of the band way at an appropriate time during the packing operation.

9. The horizontal packing apparatus according to claim 8, wherein the arch unit includes a lower section, an upper section and a vertical section, the lower and upper sections are secured to the body unit, the vertical section is removably attached to the lower and upper sections.

10. The horizontal packing apparatus according to claim 7, wherein the program incorporated in the automatic control circuit is designed to move the lower part of the band way from the initial position to the inclined position, move the same back to the initial position from the inclined position and apply compressed air to the same, at appropriate times in each cycle of the packing operation.

11. The horizontal packing apparatus according to claim 10, wherein the arch unit includes a lower section, an upper section and a vertical section, the lower and upper sections are secured to the body unit, the vertical section is removably attached to the lower and upper sections.

12. The horizontal packing apparatus according to claim 7, wherein the drive means inclines the lower part of the band way downwards in a widthwise direction of the band way.

13. The horizontal packing apparatus according to claim 7, further comprising an air hose having an air-outlet port for applying compressed air onto the lower part of the band way while the lower part remains in the inclined position.

14. The horizontal packing apparatus according to claim 7, wherein the arch unit includes a lower section, an upper section and a vertical section, the lower and upper sections are secured to the body unit, the vertical section is removably attached to the lower and upper sections.

15. A method of removing foreign matter from a horizontal packing apparatus that comprises a body unit, a table provided at a vertical side of the body unit, for supporting an article to be packed, an arch unit straddling one side of the body unit and surrounding the vertical table, and a band way for applying a band to the article, said method designed to remove foreign matter that has fallen from the article onto the band way and comprising the steps of:

moving the lower part of the band way from an initial position that is substantially horizontal to an inclined position in which the lower part is inclined downwards, after a band is released from the band way and a packing operation starts; and moving the lower part of the band back to the initial position from the inclined position.

16. A method of removing foreign matter from a horizontal packing apparatus that comprises a body unit, a table provided at a vertical side of the body unit, for supporting an article to be packed, an arch unit straddling one side of the body unit and surrounding the vertical table, and a band way for applying a band to the article, said method designed to remove foreign matter that has fallen from the article onto the band way and comprising the steps of:

moving the lower part of the band way from an initial position that is substantially horizontal to an inclined position in which the lower part is inclined downwards, after a band is released from the band way and a packing operation starts;

applying compressed air to an upper surface of the lower part of the band way; and moving the lower part of the band back to the initial position from the inclined position after the compressed air is applied to the lower part of the band way.

17. The method of removing foreign matter from a horizontal packing apparatus according to claim 16, wherein three steps for moving the lower part of the band way from an initial position, for applying the compressed air to an upper surface of the lower part of the band way; and for moving the lower part of the band back to the initial position from the inclined position are performed at appropriate times in each cycle of the packing operation.

* * * * *